US008523180B1

(12) United States Patent
Liu et al.

(10) Patent No.: US 8,523,180 B1
(45) Date of Patent: Sep. 3, 2013

(54) PAPER TRANSMITTING MECHANISM AND THE DOCUMENT FEEDER WITH THE PAPER TRANSMITTING MECHANISM

(75) Inventors: Chin-Te Liu, New Taipei (TW); I-Chuan Hong, New Taipei (TW); Lung Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/426,225

(22) Filed: Mar. 21, 2012

(51) Int. Cl.
*B65H 5/02* (2006.01)
*B65H 5/06* (2006.01)

(52) U.S. Cl.
USPC ..... 271/274; 271/272; 271/273

(58) Field of Classification Search
USPC ..... 271/272, 273, 274, 265.01
See application file for complete search history.

(56) References Cited

U.S. PATENT DOCUMENTS 7,523,933 B2 * 4/2009 Linder et al. ..... 271/274
7,722,039 B2 * 5/2010 Shoji et al. ..... 271/273
8,132,811 B2 * 3/2012 Bryl ..... 271/273
8,201,824 B2 * 6/2012 deJong et al. ..... 271/274
2007/0069456 A1 * 3/2007 Jeong ..... 271/272
2008/0042340 A1 * 2/2008 Linder et al. ..... 271/274

* cited by examiner

*Primary Examiner* — Kaitlin Joerger

(74) *Attorney, Agent, or Firm* — Muncy, Geissler, Olds & Lowe, PLLC

(57) ABSTRACT

A paper transmitting mechanism mounted on the transmitting path which includes a driving wheel, a driving system drives the driving wheel, a pressure wheel, a pressure wheel adjusting unit, and a paper sensor settled upstream to the driving wheel and pressure wheel. The pressure wheel adjusting unit includes an elastomeric unit; one end of the elastomeric unit is connected to the axle of the pressure wheel, and the other end is connected to a linear driving device. When the paper sensor detects the paper is going to enter or leave the driving wheel, the paper sensor will send a signal for adjusting the clamping force between the driving wheel and the pressure wheel to make the clamping force and the friction between the driving wheel and the pressure wheel adjustable according to the position of the paper, so as to avoid the paper slipping or vibrating during transmitting.

10 Claims, 4 Drawing Sheets

PAPER TRANSMITTING MECHANISM AND THE DOCUMENT FEEDER WITH THE PAPER TRANSMITTING MECHANISM

BACKGROUND OF THE INVENTION

1. Field of the Invention

The present invention generally relates to a paper transmitting mechanism, and more particularly to a paper transmitting mechanism with a function of detecting position of the paper and adjusting the clamping force according to the position of the paper.

2. The Related Art

With reference to FIG. 1, a common document feeder comprises a transmitting path which is defined by plenty of guiding walls and/or guiding units for guiding paper; and plenty of transmitting roller sets placed along the transmitting path to transmit paper piece by piece through the transmitting path.

The transmitting roller sets include a driving roller and a driven roller; the driving roller is connected to a driving device which drives the driving roller. The driven roller is pivotably mounted around the driving roller, and provides paper a proper clamping force and friction for transmitting.

However, paper won't be transmitted smoothly if the clamping force and the friction between the driving roller and the driven roller are too big or too small. For example, if the clamping force and the friction are too small, the paper is apt to slip during the transmitting, and makes images misplaced.

In opposite, if the clamping force and the friction are too big, the paper might be pulled by the transmitting roller sets upstream and downstream, and shakes the paper and twists the image.

In view of these disadvantages above, the paper transmitting mechanism and the document feeder should be improved.

SUMMARY OF THE INVENTION

An object of the present invention is to provide a paper transmitting mechanism which can adjust the clamping force and the friction between the pressure wheel and the driving wheel according to the position or the transmitting status of the paper.

To reach such purpose, the paper transmitting mechanism in this invention is settled along the transmitting path and includes a driving system, a driving wheel, a pressure wheel, a pressure wheel adjusting unit, and a paper sensor.

The driving system is connected with the driving wheel and provides the driving wheel torque for transmitting the paper; the pressure wheel is pivotably mounted around the driving wheel and clamps the paper with the driving wheel together. The pressure wheel includes a first rolling portion and a second rolling portion both mounted at the same axis. Wherein, the radius of the second rolling portion is larger than the radius of the first rolling portion, and the second rolling portion is made of softer material (such as foam).

The axle of the pressure wheel is connected with the pressure wheel adjusting unit, and driven close or away by the pressure wheel adjusting unit. The paper sensor is electronically connected with the pressure wheel adjusting unit and controls the pressure wheel adjusting unit according to the position of paper.

In this embodiment, the paper sensor is placed upstream to the driving wheel and the pressure wheel to detect the position of paper and control the pressure wheel adjusting unit immediately.

In another feasible embodiment, the pressure wheel adjusting unit includes a linear driving device controlled to move along a predetermined path and drives the axle of the pressure wheel.

In a better embodiment, the pressure wheel adjusting unit further includes an elastomeric unit. One end of the elastomeric unit is connected to the axle of the pressure wheel, the other end of the elastomeric unit is connected to the linear driving device to provide buffer by the elastic deformation of the pressure wheel and the elastomeric unit.

Therefore, the paper sensor can control the pressure wheel adjusting unit to increase or decrease the clamping force between the driving wheel and the pressure wheel immediately when it detects the paper either entering or leaving the paper transmitting mechanism.

With the paper transmitting mechanism described above, this invention further provides a document feeder which can avoid the paper slipping or vibrating during the transmitting. The document feeder comprises a transmitting path, an operating area placed in the middle of the transmitting path, a paper transmitting mechanism, and a roller set.

The paper transmitting mechanism is settled upstream to the operating area, and the roller set is placed downstream to the operating area. The distance between the paper transmitting mechanism and the roller set is shorter than the length of the paper to which they are transmitting to make sure both ends of the paper are clamped stably during the transmitting.

The paper transmitting mechanism includes a driving system, a driving wheel, a pressure wheel, a pressure wheel adjusting unit, and a paper sensor.

The driving system is connected to the driving wheel and provides the driving wheel torque for transmitting the paper; the pressure wheel is pivotably mounted around the driving wheel and clamps the paper with the driving wheel together. The pressure wheel includes a first rolling portion and a second rolling portion mounted to the same axis, wherein the radius of the second rolling portion is larger than the radius of the first rolling portion. The second rolling portion is made of softer material (such as foam).

The axle of the pressure wheel is connected with the pressure wheel adjusting unit, and driven close or away by the pressure wheel adjusting unit. The paper sensor is electronically connected with the pressure wheel adjusting unit and controls the pressure wheel adjusting unit according to the position of paper.

The roller comprises a driving device, a driving roller, and a driven roller. The driving device is connected with the driving roller, and provides torque to the driving roller for transmitting the paper; the driven roller is pivotably mounted around the driving roller, and clamps the paper with the driving roller together.

In this embodiment, the paper sensor is placed upstream to the driving wheel and the pressure wheel to detect the position of paper and control the pressure wheel adjusting unit immediately.

In another feasible embodiment, the pressure wheel adjusting unit includes a linear driving device, the linear driving device is controlled to move along a predetermined path and drive the axle of the pressure wheel.

In a better embodiment, the pressure wheel adjusting unit further includes an elastomeric unit. One end of the elastomeric unit is connected to the axle of the pressure wheel, and the other end of the elastomeric unit is connected to the linear driving device, and provides buffer by the elastic deformation of the pressure wheel and the elastomeric unit.

As described above, the pressure wheel in this invention is connected to a pressure wheel adjusting unit which can adjust the clamping force between the pressure wheel and the driving wheel automatically according to the position of paper and the transmitting status. Furthermore, the pressure wheel is composed of the first rolling portion and the softer but larger second rolling portion; it makes the pressure wheel keeping contacted with the driving wheel.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
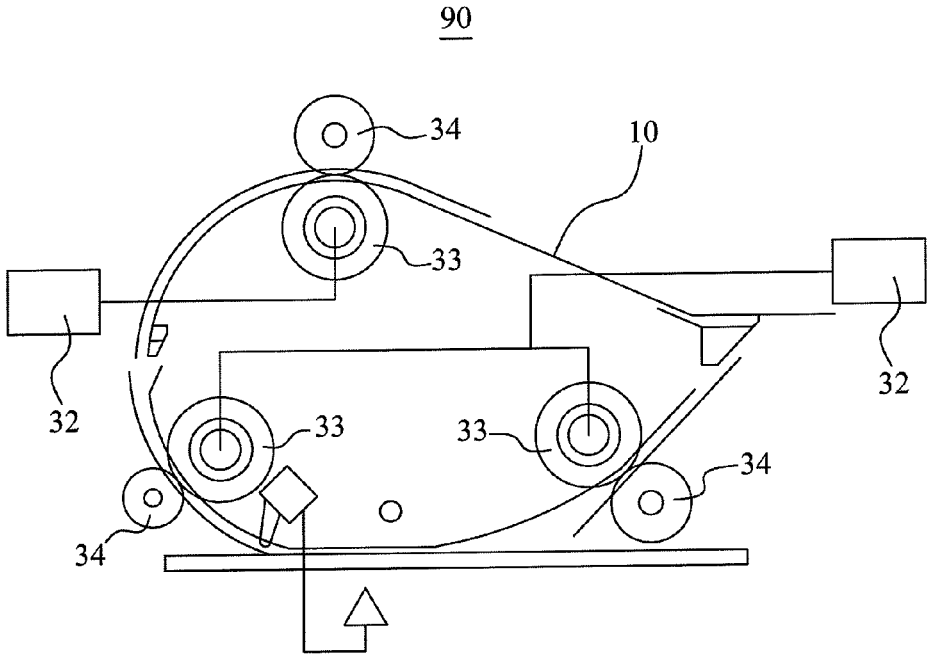
FIG. 1 is a side-sectional view of a common document feeder.
Figure 2:
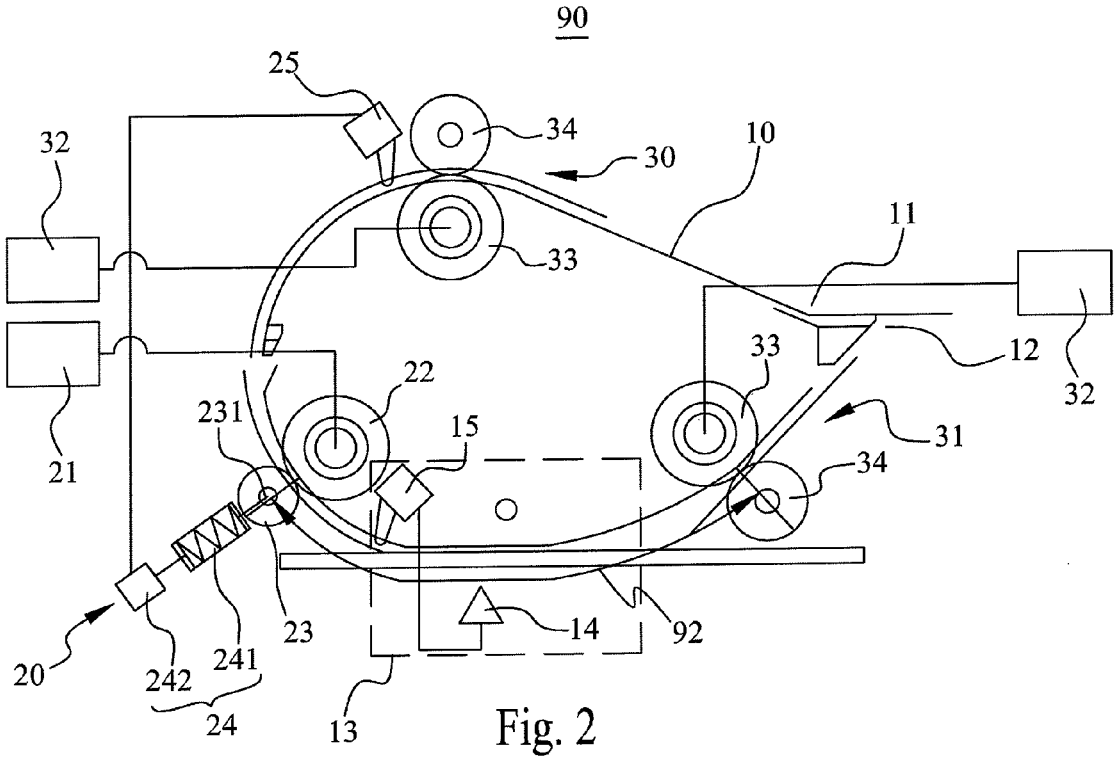
FIG. 2 is a side-sectional view of a document feeder which comprises the paper transmitting mechanism of present invention.

With reference to FIG. 2, a paper transmitting mechanism 90 in accordance with the present invention is shown. The paper transmitting mechanism 90 includes a U-shaped transmitting path 10. Paper 91 enters the transmitting path 10 from the entrance 11 located at the top-right of the transmitting path 10, then is transmitted through the transmitting path 10 and leave from the exit 12 at the bottom-right of the transmitting path 10.

In order to describe the present invention more clearly, the transmitting path is considered a one-way path in the descriptions below, and comparing two random points in the transmitting path, the side closer to the entrance 11 would be defined as upstream, the side closer to the exit 12 would be defined as downstream.

An operating area 13 is located on the transmitting path 10 between the entrance 11 and the exit 12, at least one device for processing paper is settled in the operating area. In this embodiment, a scanner 14 and a scan sensor 15 is located in the operating area 13. When the paper 91 trigger the paper sensor 25, the scanner will be activated and start to scan.

A first roller set 30, a paper transmitting mechanism 20, and a second roller set 31 are mounted along the transmitting path 10 sequentially. The paper transmitting mechanism 20 is located upstream to the operating area 13, and the second roller set 31 is located downstream to the operating area 13; the distance 92 between the paper transmitting mechanism 20 and the second roller set 31 is shorter than the length of the paper 91 to make sure the front and rear end of the paper 91 is clamped stably during the transmitting and avoid the paper 91 slipping at scanning.

The first roller set 30 and the second roller set 31 include a driving device 32, a driving roller 33, and a driven roller 34. The driving device 32 connected with the driving roller 33, and provides torque to the driving roller 33 for transmitting the paper 91. The driving roller 33 and the driven roller 34 are both mounted to fixed axle, makes the driven roller 34 to clamp and transmit the paper 91 downstream with the driving roller 33 together.

An adjustable pressure wheel 23 is mounted in the paper transmitting mechanism 20, it includes a driving system 21, a driving wheel 22 connected with the driving system 21, a pressure wheel adjusting unit 20, a pressure wheel 23, and a paper sensor 25.

The pressure wheel adjusting unit 20 is connected with the axle 231 of the pressure wheel 23, and drives the axle 231 to move. In this embodiment, a linear driving device 242 is mounted in the pressure wheel adjusting unit 24, the linear driving device 242 is controlled to move along a predetermined path and drives the axle 231 of the pressure wheel 23 to move. An elastomeric unit 241 is connected between the pressure wheel 23 and the linear driving device 242, one end of the elastomeric unit 241 is connected with the axle 231 of the pressure wheel 23 and the other end of the elastomeric unit 241 is connected with the linear driving device 242 to offer buffer by the deformation of the pressure wheel 23 and the elastomeric unit 241 due to the clamping force.

When the elastomeric unit 241 is compressed, the elastomeric unit 241 provides more normal stress to the pressure wheel 23 and increases the clamping force between the pressure wheel 23 and the driving wheel 22. In opposite, when the elastomeric unit 241 is released, the elastomeric unit 241 offers less normal stress to the pressure wheel 23 and decrease the clamping force and friction between the pressure wheel 23 and the driving wheel 22.

Figure 3:
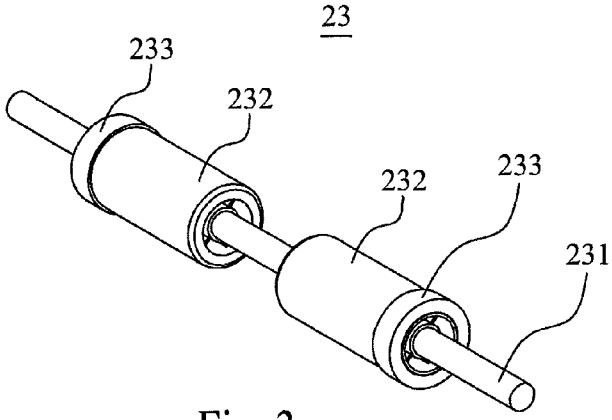
FIG. 3 is a perspective view of a pressure wheel of the paper transmitting mechanism of the present invention.

Referring to FIG. 3, to make the paper 91 transmit more stably, the pressure wheel 23 further includes a first rolling portion 232 and a second rolling portion 233, the first rolling portion 232 and the second rolling portion 233 is settled in the same axis. The radius of second rolling portion 233 is larger than the radius of the first rolling portion 232. The second rolling portion 233 is made of the material which is softer (such as foam) than that of the first rolling portion 232. Therefore, the second rolling portion 233 which becomes larger and softer can keep contacting with the driving wheel 22, and deform easily when the clamping force between the driving wheel 22 and the pressure wheel 23 increased to clamp the paper 91 more averagely.

Figure 4:
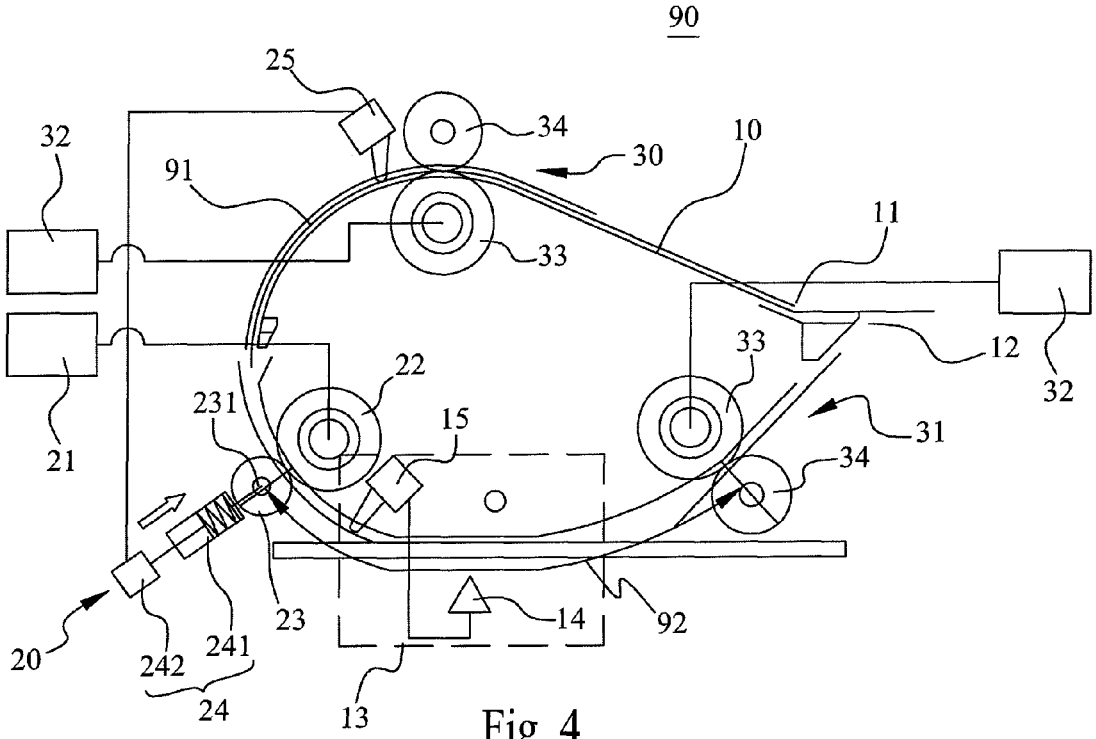
FIG. 4 is a side-sectional view that shows the operating process of the document feeder in FIG. 2.

Referring to FIG. 4, a document feeder 90 with the paper transmitting mechanism 20 in accordance with the present invention proceeds as following: when the paper 91 enters the transmitting path 10, it would be guide to the operating area 13 by the first roller set 30 and the transmitting path 10 and trigger the paper sensor 25 after being transmitted through the first roller set 30, and activate the paper sensor 25 to send a paper-entering signal for controlling the pressure wheel adjusting unit 24 to increase the clamping force between the driving wheel 22 and the pressure wheel 23.

Figure 5:
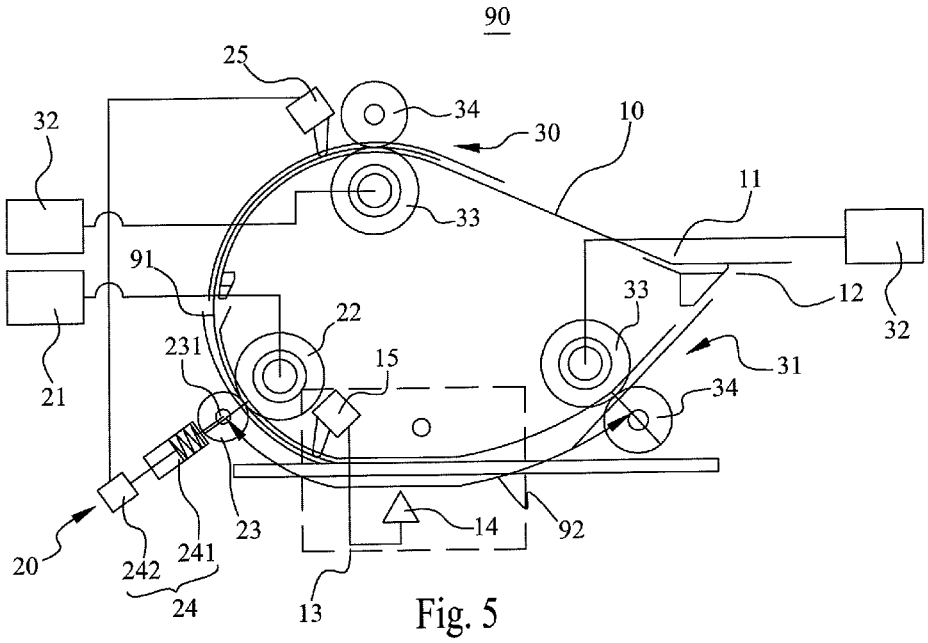
FIG. 5 is a side-sectional view that shows the operating process of the document feeder in FIG. 2.

Referring to FIG. 5, the paper 91 transmitted to the downstream of the transmitting path 10 will be clamped by the paper transmitting mechanism 20. Meanwhile, the paper transmitting mechanism 20 increases the clamping force upon receiving the paper-entering signal to avoid the paper 91 slipping during the transmitting. After that, the paper 91 will be transmitted downstream and triggers the scan sensor to activate the scanner starting scan.

Figure 6:
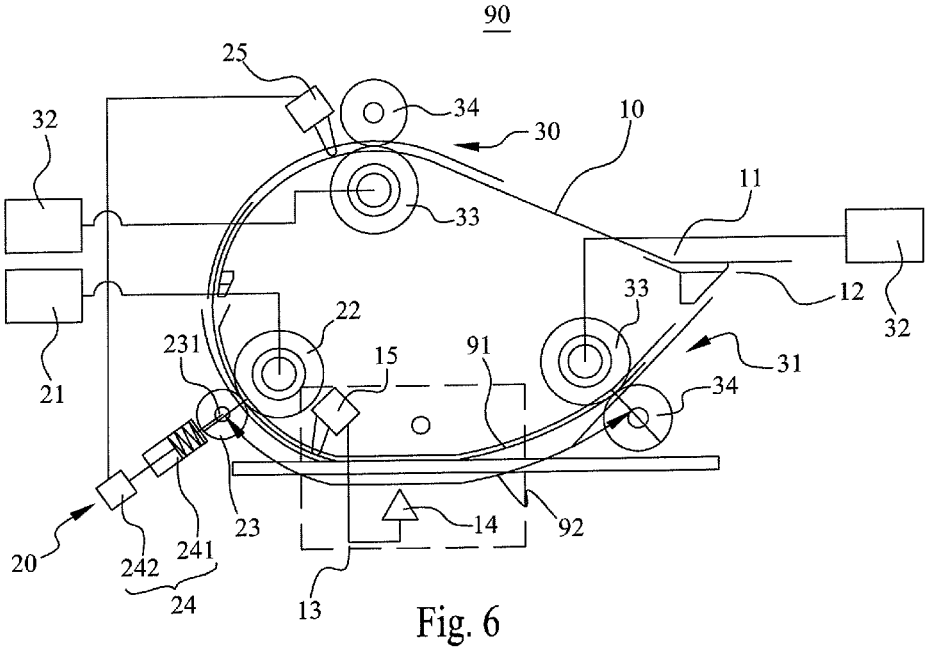
FIG. 6 is a side-sectional view that shows the operating process of the document feeder in FIG. 2.

Referring to FIG. 6, the paper 91 is transmitted downstream, and clamped by the second roller set 31. The front and rear end of the paper 91 is clamped by the paper transmitting mechanism 20 and the second roller set 31 to make sure the paper 91 keeping stable and not to slip during the scanning.

Figure 7:
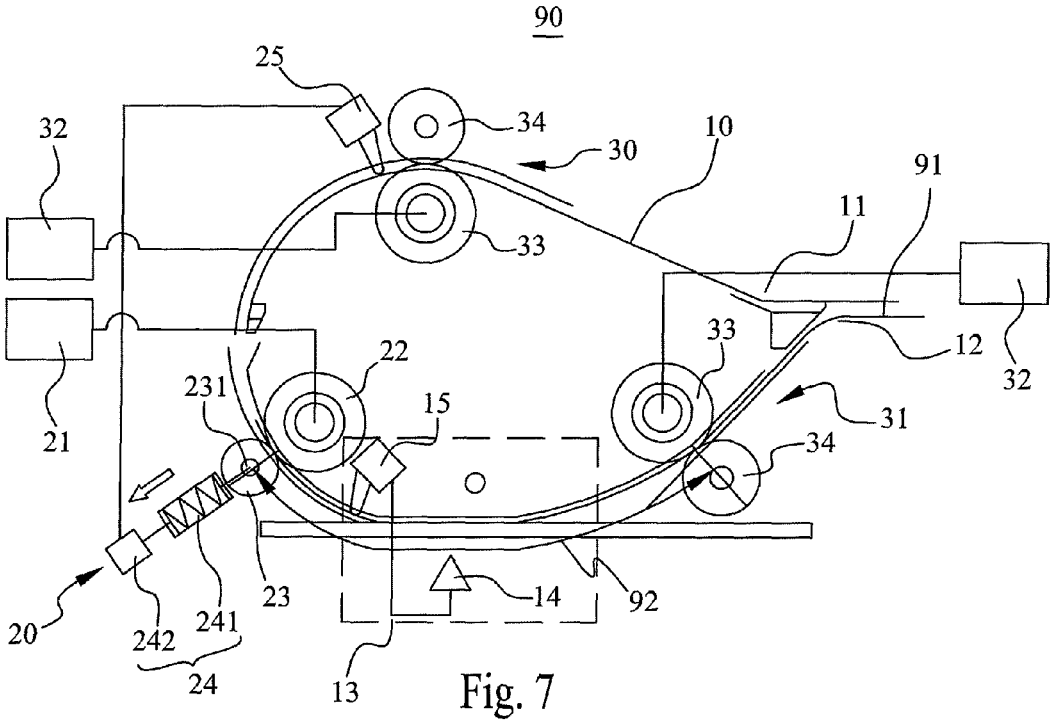
FIG. 7 is a side-sectional view that shows the operating process of the document feeder in FIG. 2.

Referring to FIG. 7, the paper 91 is transmitted downstream and left on the trigger area of the paper sensor 25. The paper sensor 25 sent a paper-leaving signal for controlling the pressure wheel adjusting unit 24 to decrease the clamping force between the driving wheel 22 and the pressure wheel 23 after a predetermined delay. It avoids the paper 91 vibrating when the paper 91 leaves the paper transmitting mechanism 20.

Figure 8:
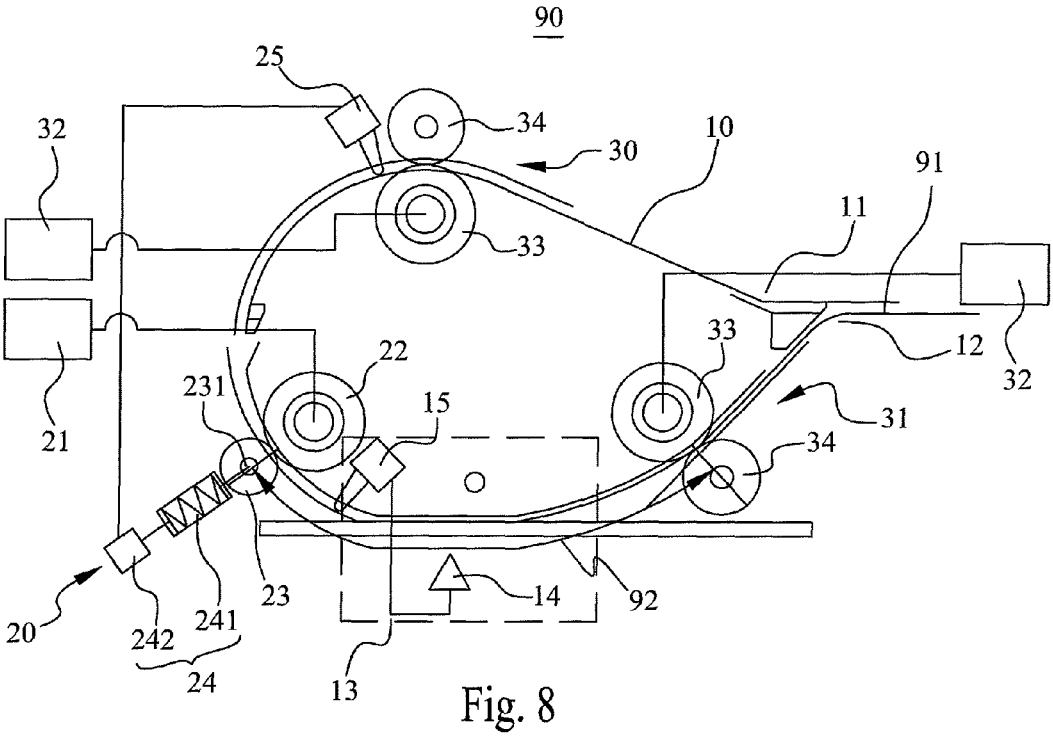
FIG. 8 is a side-sectional view that shows the operating process of the document feeder in FIG. 2.

Referring to FIG. 8, the paper 91 is transmitted to the exit 12, and leaves the trigger area of the scan sensor 15. The scan sensor 15 is deactivated and stops the scan process.

As described above, the pressure wheel is connected with a pressure wheel adjusting unit, and the pressure wheel adjusting unit is electronically connected with a paper sensor. It makes the pressure wheel be able to adjust the clamping force according to the position and the transmitting status of the paper. Furthermore, the pressure wheel is combined by a smaller but harder first rolling portion and a softer but larger second rolling portion to keep the pressure wheel contacting with the driving wheel for offering clamping force and avoiding the paper slipping.

What is claimed is:

1. A paper transmitting mechanism, comprising:

a driving system;

a driving wheel connected to the driving system;

a pressure wheel settled around the driving wheel, the pressure wheel including a first rolling portion and a second rolling portion being coaxial to the first rolling portion, the second rolling portion is easier to deform than the first rolling portion and the radius of the second rolling portion is larger than the radius of the first rolling portion;

a pressure wheel adjusting unit connected to the axle of the pressure wheel, the pressure wheel adjusting unit provides the clamping force between the driving wheel and the pressure wheel; and a paper sensor electronically connected to the pressure wheel adjusting unit, and controls the pressure wheel adjusting unit, wherein the sensor is settled at the upstream of the driving wheel and the pressure wheel.

2. The paper transmitting mechanism as claimed in claim 1, wherein the material used to make the second rolling portion be softer than the material used to make the first rolling portion.

3. The paper transmitting mechanism as claimed in claim 1, wherein the pressure wheel adjusting unit including an elastomeric parts; one end of the elastomeric parts is connected to the axle of the pressure wheel, the other end is connected to a linear driving device; the linear driving device is controlled to move along a predetermined path and deform the elastomeric parts.

4. A paper transmitting mechanism, comprising:

a driving system;

a driving wheel connected to the driving system;

a pressure wheel settled around the driving wheel;

a pressure wheel adjusting unit connected to the axle of the pressure wheel, the pressure wheel adjusting unit provides the clamping force between the driving wheel and the pressure wheel; and a paper sensor electronically connected to the pressure wheel adjusting unit, the paper sensor is settled at the upstream of the driving wheel and the pressure wheel, and controls the pressure wheel adjusting unit.

5. The paper transmitting mechanism as claimed in claim 4, wherein the pressure wheel including a first rolling portion and a second rolling portion coaxial to the first rolling portion, the radius of the second rolling portion is larger than the radius of the first rolling portion and the material used to make the second rolling portion is softer than the material used to make the first rolling portion.

6. The paper transmitting mechanism as claimed in claim 4, wherein the pressure wheel adjusting unit including an elastomeric parts; one end of the elastomeric parts is connected to the axle of the pressure wheel, the other end is connected to a linear driving device; the linear driving device is controlled to move along a predetermined path and deform the elastomeric parts.

7. An automatic document feeder, comprising:

a transmitting path;

an operating area located in the middle of the transmitting path;

a first paper transmitting mechanism settled at the upstream of the operating area, which comprises a driving system; a driving wheel connected to the driving system; a pressure wheel; a pressure wheel adjusting unit connected to the axle of the pressure wheel provides the clamping force between the driving wheel and the pressure wheel; and a paper sensor electronically connected to the pressure wheel adjusting unit for controlling the pressure wheel adjusting unit, wherein the paper sensor is settled at the upstream of the driving wheel and the pressure wheel; and a second paper transmitting mechanism settled at the downstream of the operating area, which comprises a driving system; a driving wheel connected to the driving system; and a pressure wheel settled around the driving wheel;

wherein the distance between the first transmitting mechanism and the second transmitting mechanism is shorter than the length of the paper transmitted.

8. The automatic document feeder as claimed in claim 7, wherein the pressure wheel including a first rolling portion and a second rolling portion coaxial to the first rolling portion, the radius of the second rolling portion is larger than the radius of the first rolling portion.

9. The automatic document feeder as claimed in claim 8, wherein the material of the second rolling portion is softer than the material of the first rolling portion.

10. The automatic document feeder as claimed in claim 7, wherein the pressure wheel adjusting unit including an elastomeric parts; one end of the elastomeric parts is connected to the axle of the pressure wheel, the other end is connected to a linear driving device; the linear driving device is controlled to move along a predetermined path and deform the elastomeric parts.

* * * * *